US006453700B1

(12) United States Patent
Avril

(10) Patent No.: US 6,453,700 B1
(45) Date of Patent: Sep. 24, 2002

(54) MULTI-STONE SETTING MEMBER FOR ATTACHMENT TO A RING

(75) Inventor: Gail Avril, New York, NY (US)

(73) Assignee: L.I.D. Ltd., New York, NY (US)

( * ) Notice: Subject to any disclaimer, the term of this patent is extended or adjusted under 35 U.S.C. 154(b) by 0 days.

(21) Appl. No.: 09/501,361

(22) Filed: Feb. 10, 2000

(51) Int. Cl.[7] ..... A44C 17/02

(52) U.S. Cl. ..... 63/26; 63/27; 63/28; D11/91; D11/92

(58) Field of Search ..... 63/26, 27, 28; D11/91, 92

(56) References Cited

U.S. PATENT DOCUMENTS 6,003,335 A * 12/1999 Gurevich et al. ..... 63/26

* cited by examiner

*Primary Examiner*—J. J. Swann
*Assistant Examiner*—Andrea Chop

(74) *Attorney, Agent, or Firm*—Ezra Sutton

(57) ABSTRACT

A multi-stone setting member has six gemstones or diamonds for attachment to a ring. The multi-stone setting member includes a rectangular-shaped housing having a first crossbar extending in a first direction; a second crossbar having first insert edges extending in a second direction perpendicular to the first direction; a third crossbar having second insert edges and being parallel to the second crossbar and also extending in the second direction; and the first crossbar is located in a different plane than the second and third crossbars. The first, second and third crossbars form six seats each for receiving one of six gemstones or diamonds. The setting member includes a frame assembly having a front wall, a rearwall and side walls. The front and rear walls of the frame assembly each include an upper end for engaging the four outer gemstones in the first and second outer rows of gemstones to keep the four outer gemstones seated within the four outer seats of the setting member. Also, the front and rear walls each includes a pair of positioning pins for connecting and attaching the setting member to the sides of a ring.

8 Claims, 9 Drawing Sheets

MULTI-STONE SETTING MEMBER FOR ATTACHMENT TO A RING

FIELD OF THE INVENTION

The present invention relates to a multi-stone setting member for attachment to a ring. More particularly, this multi-stone setting member has six (6) rectangular-shaped or square-shaped gemstones (princess cut gemstones) in which the combined gemstone aggregate gives a larger appearance than that of a single gemstone of a similar carat weight.

BACKGROUND OF THE INVENTION

Invisible gemstone settings are well known in the art and refers to a setting for gemstones in which the setting lies beneath the visible surface of the gemstones. Typically, to invisibly set a large number of gemstones, the approach of the prior art has been to notch the gemstones and to mount them in a setting having two or more parallel walls, with metallic projections, for example, prongs or the like, protruding from these walls for engaging the notches. Generally, these walls define channels in which the gemstones are set abutting one another in accordance with the invisible mounting method.

Invisible gemstone settings for jewelry products suffer from a number of disadvantages. First, casting of a jewelry item with a gemstone region including a recess and walls and preparing T-shaped cross bars is a relatively difficult and therefore costly process. Second, the assembly of the jewelry item requires considerable time of a skilled worker which adds greatly to the overall cost of the jewelry item. And third, the finished jewelry item cannot be readily downsized without disturbing the invisible gemstone setting.

Therefore, there remains a need for a novel invisible and multiple gemstone setting for attachment to rings which overcomes the disadvantages of conventional multi-stone and invisible gemstone settings for jewelry items. The multi-stone setting member would include a rectangular-shaped or square-shaped metal setting for holding six princess cut gemstones in which the combined gemstone aggregate gives a larger appearance than that of a single gemstone of a similar carat weight, and the setting having a plurality of positioning pins thereon for mounting of the setting member to a ring. Additionally, the multi-stone setting would give the appearance that the rectangular setting (metal) is essentially invisible to the eye of the wearer.

DESCRIPTION OF THE PRIOR ART

Invisible gemstone settings, multi-gemstone settings, jewelry settings and the like having various designs, structures, configurations and functions have been disclosed in the prior art. For example, U.S. Pat. No. 5,848,539 to OUZOUNIAN discloses an invisible, multiple precious stone setting for mounting two or more rows of round-shaped precious stones. This prior art patent does not disclose the structure and configuration of the present invention.

U.S. Pat. No. 5,520,017 to VIVAT discloses jewelry items with invisible gemstone settings, wherein the gemstone setting includes a least two walls so as to provide at least one groove. The groove slidably receives one or more rectangularly-shaped precious stones therein. This prior art patent does not disclose the structure and configuration of the present invention.

U.S. Pat. No. 5,123,265 to RAMOT discloses an invisible gemstone setting, wherein the gemstone setting assembly includes one or more gemstones and a setting having a base formed with a plurality of ribs defining one or more sockets of polygonal configuration for receiving the gemstones. This prior art patent does not disclose the structure and configuration of the present invention.

U.S. Pat. No. Des. D403,611 to LAI discloses an ornamental design for a jewelry setting having a square-shaped pattern for square-shaped gemstones. This prior art patent does not disclose the structure and configuration of the present invention.

None of the aforementioned prior art patents disclose or teach the multi-stone setting member of the present invention for receiving therein six rectangular-shaped or square-shaped gemstones which gives the appearance of a single gemstone with the setting having an invisible profile.

Accordingly, it is an object of the present invention to provide a multi-stone setting member for holding therein six rectangular-shaped or square-shaped gemstones in which the combined aggregate of the six gemstones gives a larger appearance than that of a single gemstone of a similar carat weight (i.e., a 1.2 carat presentation of the combined six gemstones appears as large as a 2.0 carat gemstone, as the present invention would have a larger table).

Another object of the present invention is to provide a multi-stone setting member having six gemstones therein that is less expensive than a single gemstone of a similar carat weight (i.e., the 1.2 carat presentation of the combined six gemstones is less expensive than an actual 1.2 carat single gemstone of the same carat weight).

Another object of the present invention is to provide a multi-stone setting member having six princess cut gemstones therein which gives the appearance that the setting is substantially invisible at distances greater than 12 inches from the jewelry product.

Another object of the present invention is to provide a multi-stone setting member that can be varied in size depending upon the total combined carat weight of the six gemstones within the setting member.

Another object of the present invention is to provide a multi-stone setting member that can be made from precious metals such as gold, silver, platinum or palladium for setting precious gemstones including diamonds, rubies, sapphires, emeralds and the like.

Another object of the present invention is to provide a multi-stone setting member that can be attached to a jewelry ring by a plurality of positioning pins integrally connected to the member housing.

Another object of the present invention is to provide a multi-stone setting member having six gemstones therein for use in personal adornment in the form of ornamental jewelry such as rings.

Another object of the present invention is to provide a multi-stone setting member that can be produced in an economical manner and is readily affordable by the jewelry consumer.

SUMMARY OF THE INVENTION

In accordance with the present invention, there is provided a multi-stone setting member has six gemstones or diamonds for attachment to a ring. The multi-stone setting member includes a rectangular-shaped housing having a first crossbar extending in a first direction; a second crossbar having first insert edges extending in a second direction perpendicular to the first direction; a third crossbar having second insert edges and being parallel to the second crossbar and also extending in the second direction; and the first crossbar is located in a different plane than the second and third crossbars. The first, second and third crossbars form six seats each for receiving one of six gemstones or diamonds. The said first, second and third crossbars define two outer rows of seats to form four outer seats, and one inner row of seats to form two inner seats for receiving the six gemstones. The first outer row of gemstones have a first set of inner side walls for engaging the second crossbar and the first set of inner side walls have grooves formed therein for seating the first outer row of gemstones on the first insert edges of the second crossbar. The second outer row of gemstones have a second set of inner side walls for engaging the third crossbar, and the second set of inner side walls have grooves formed therein for seating the second outer row of gemstones on the second insert edges of the third crossbar. The inner row of gemstones have first inner side walls for engaging the second crossbar and second inner side walls for engaging the third crossbar. The first and second inner side walls having grooves formed therein for seating the inner row of gemstones on the other one of the first insert edges and on the other one of the second insert edges of the second and third crossbars, respectively. The setting member includes a frame assembly having a front wall, a rear wall and side walls. The front and rear walls of the frame assembly each include an upper end for engaging the four outer gemstones in the first and second outer rows of gemstones to keep the four outer gemstones seated within the four outer seats of the setting member. Also, the front and rear walls each includes a pair of positioning pins for connecting and attaching the setting member to the sides of a ring.

BRIEF DESCRIPTION OF THE DRAWINGS

Further objects, features, and advantages of the present invention will become apparent upon the consideration of the following detailed description of the presently preferred embodiment when taken in conjunction with the accompanying drawings, wherein.

DETAILED DESCRIPTION OF THE PREFERRED EMBODIMENT

Figure 10:
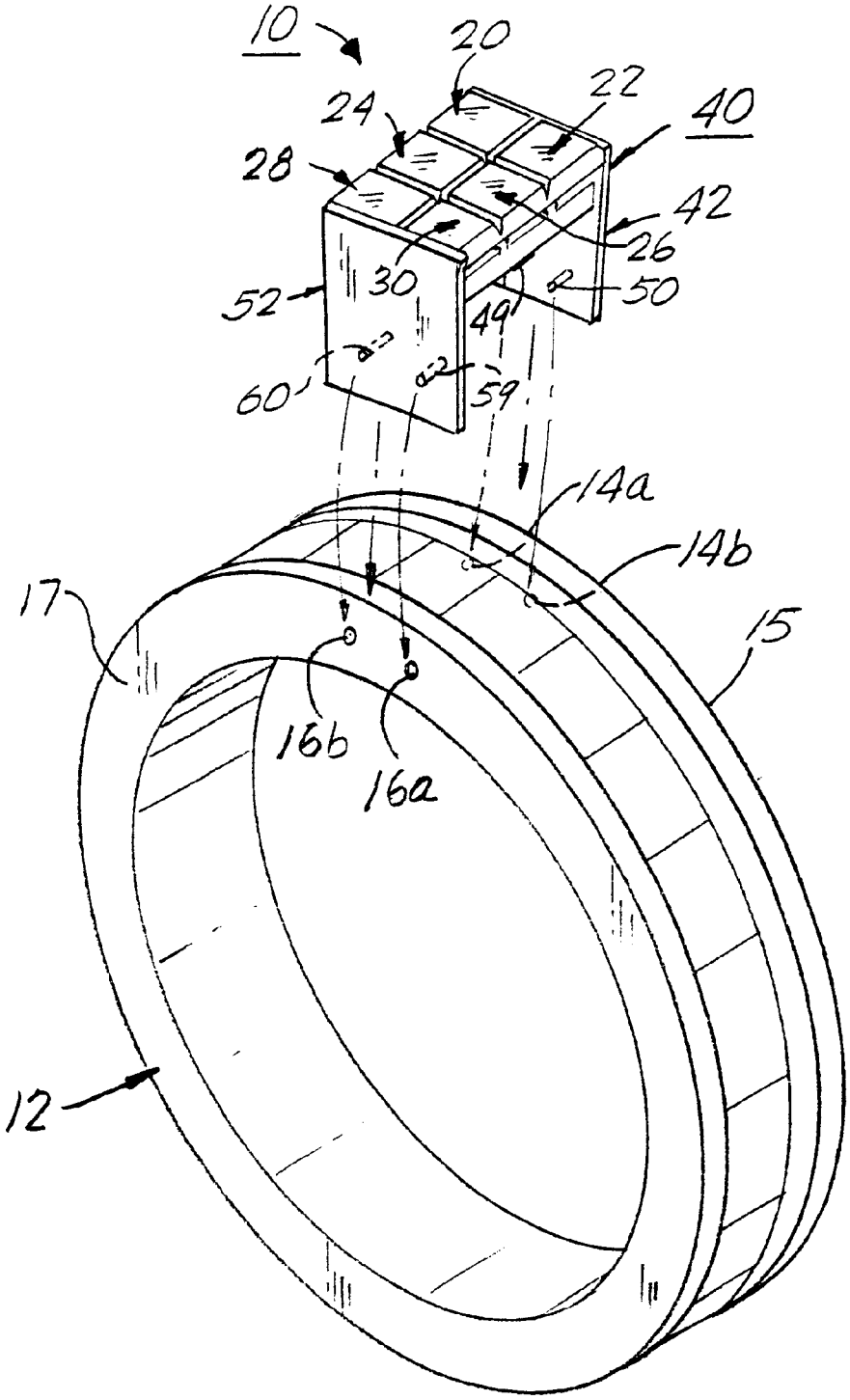
FIG. 10 is an enlarged top perspective view of the multi-stone setting member of the present invention showing six square-shaped diamonds seated within the six seats of the gemstone setting and being connected to a ring holding member via the plurality of positioning pins to form a diamond ring.
Figure 11:
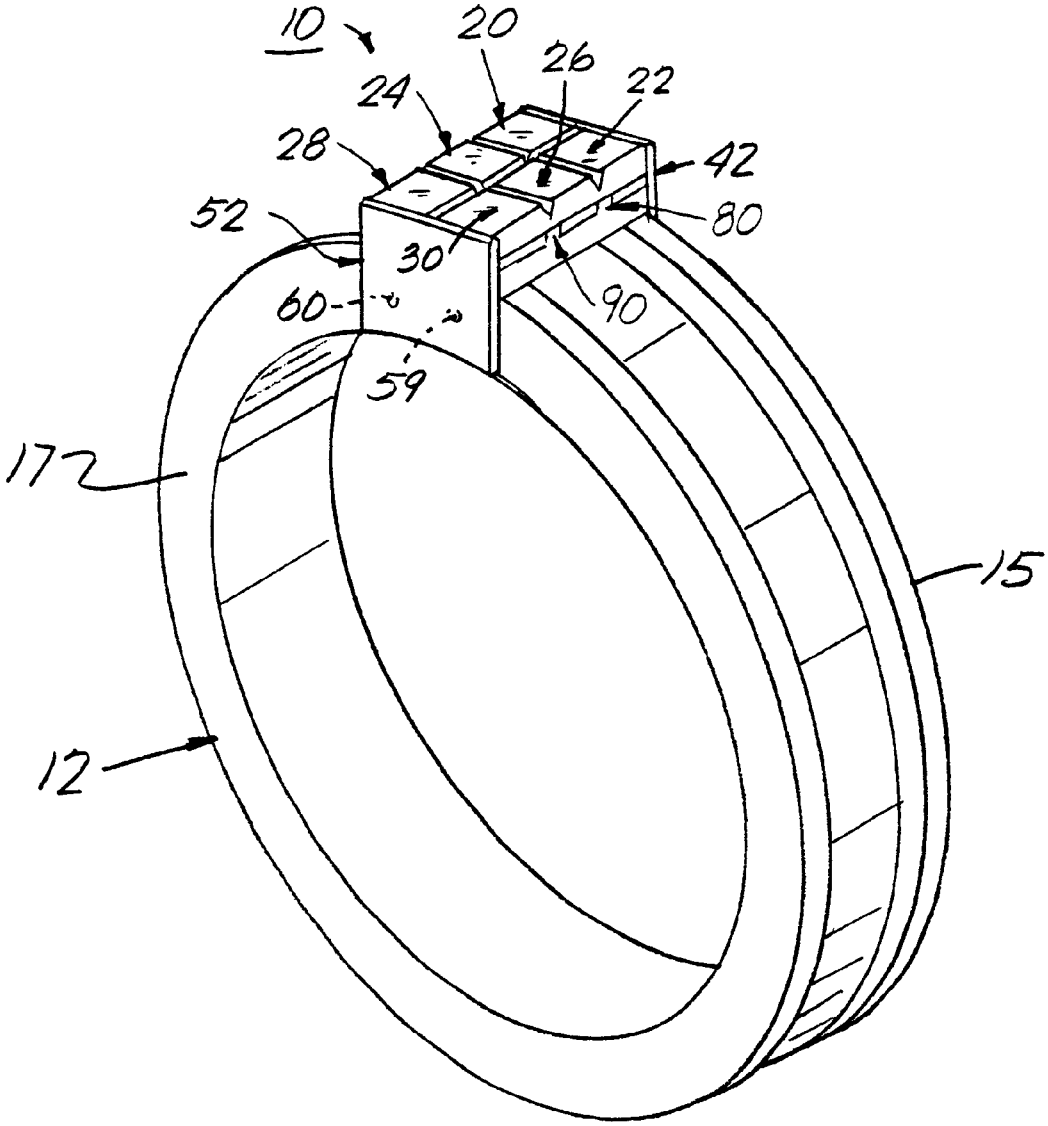
FIG. 11 is a top perspective view of the multi-stone setting member of the present invention showing six square-shaped diamonds seated within the six seats of the setting member for forming the diamond ring of the preferred embodiment.
Figure 13:
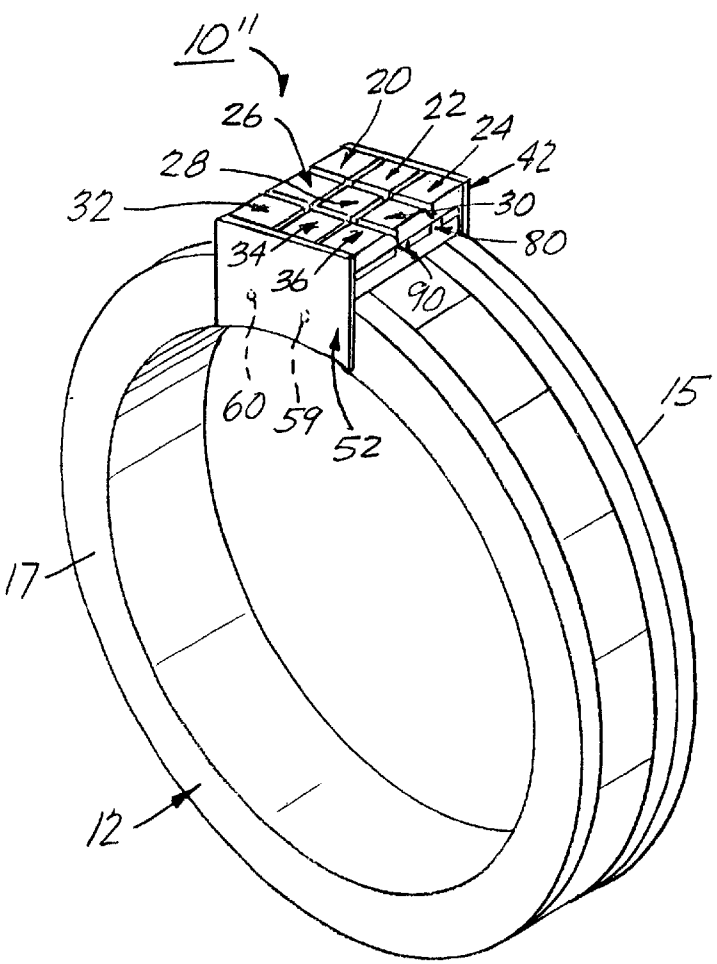
FIG. 13 is a top perspective view of the multi-stone setting member of a second alternate embodiment of the present invention showing nine square-shaped diamonds seated within the nine seats of the setting member for forming an alternate diamond ring of the second alternate embodiment.
Figure 12:
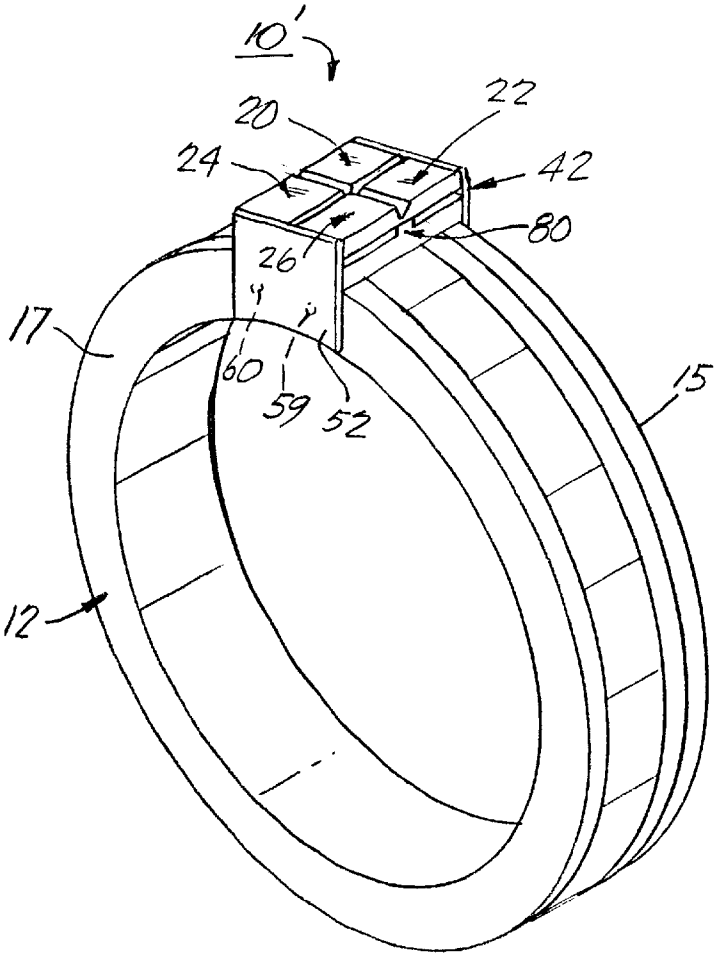
FIG. 12 is a top perspective view of the multi-stone setting member of an alternate embodiment of the present invention showing four square-shaped diamonds seated within the four seats of the setting member for forming an alternate diamond ring of the alternate embodiment.

The multi-stone setting member 10 and its component parts of the preferred embodiment of the present invention are represented in detail by FIGS. 1 through 11 of the patent drawings. The multi-stone setting member 10 has six (6) seating areas 100, 102, 104, 106, 108 and 110 for receiving six (6) diamonds 20, 22, 24, 26, 28 and 30 and is used for an additional or add-on ornamentation to a diamond jewelry ring 12, as shown in FIG. 10 and 11 of the drawings. The multi-stone setting member 10 is representative of this structure and configuration, but it can also be configured to include only four (4) seats for receiving four (4) diamonds 20, 22, 24 and 26 or nine (9) seats for nine (9) diamonds 20, 22, 24, 26, 28, 30, 32, 24 and 36 for the multi-stone setting members 10' and 10", as depicted in FIGS. 12 and 13 of the patent drawings, respectively.

Figure 1:
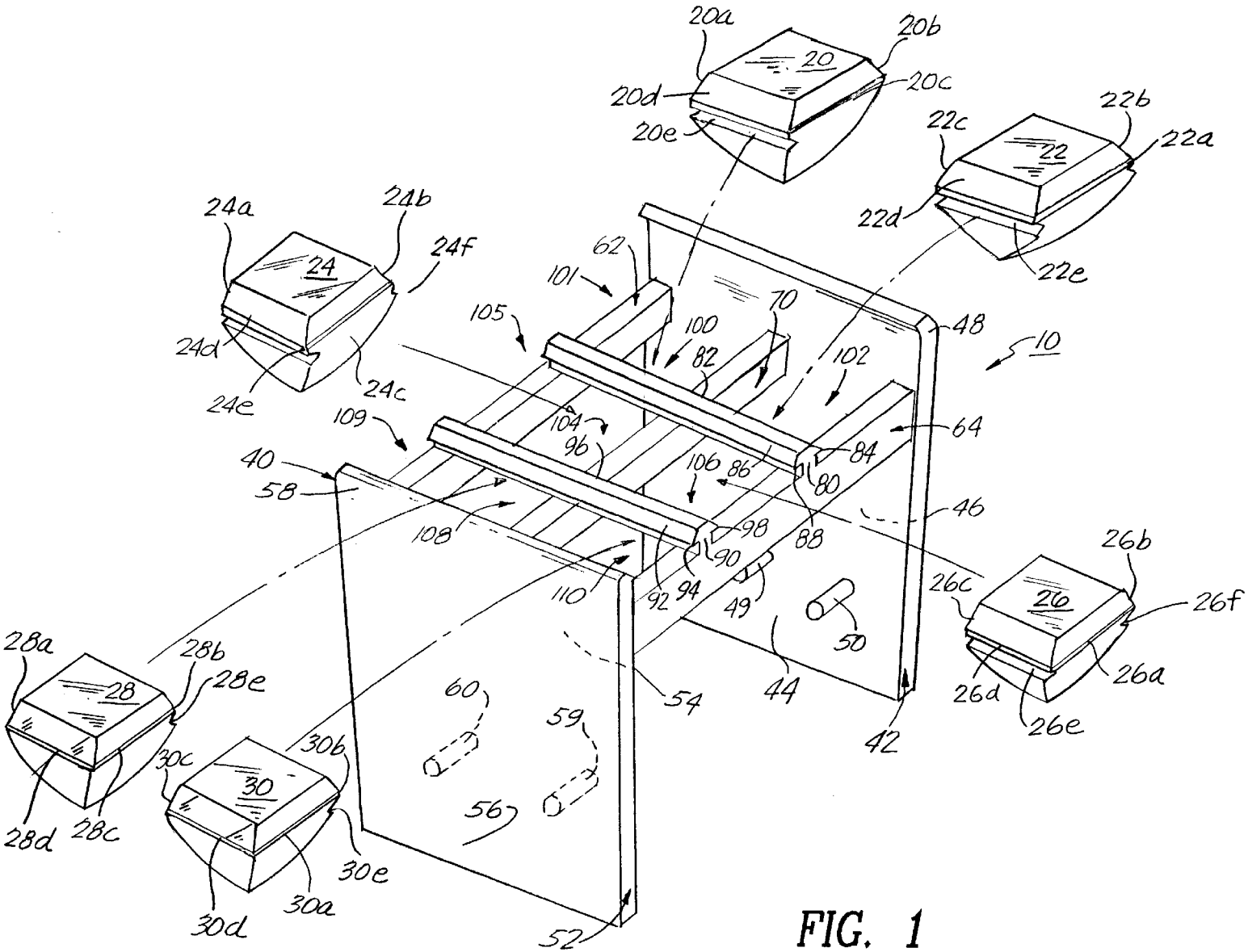
FIG. 1 is a top perspective view of the multi-stone setting member for holding six gemstones or diamonds of the preferred embodiment of the present invention.

The multi-stone setting member 10 is used for holding in place six (6) rectangular-shaped or square-shaped diamonds 20, 22, 24, 26, 28 and 30 with each diamond 20 to 30 having four side walls 20*a* to 20*d*, 22*a* to 22*d*, 24*a* to 24*d*, 26*a* to 26*d*, 28*a* to 28*d* and 30*a* to 30*d*, respectively. The multi-stone setting member 10, as shown in FIG. 1 of the drawings, includes a frame assembly 40 having a front wall 42 with an interior wall surface 44 and an exterior wall surface 46, a rear wall 52 with an interior wall surface 54 and an exterior wall surface 56, and a pair of side walls 62 and 64, respectively. Interior wall surfaces 44 and 54 each include a pair of positioning pins 49, 50, 59 and 60, respectively, being centrally located on each interior wall surface 44 and 54, respectively. Positioning pins 49, 50, 59 and 60 are for attaching and connecting to ring 12, as shown in FIG. 10 of the drawings.

Figure 3:
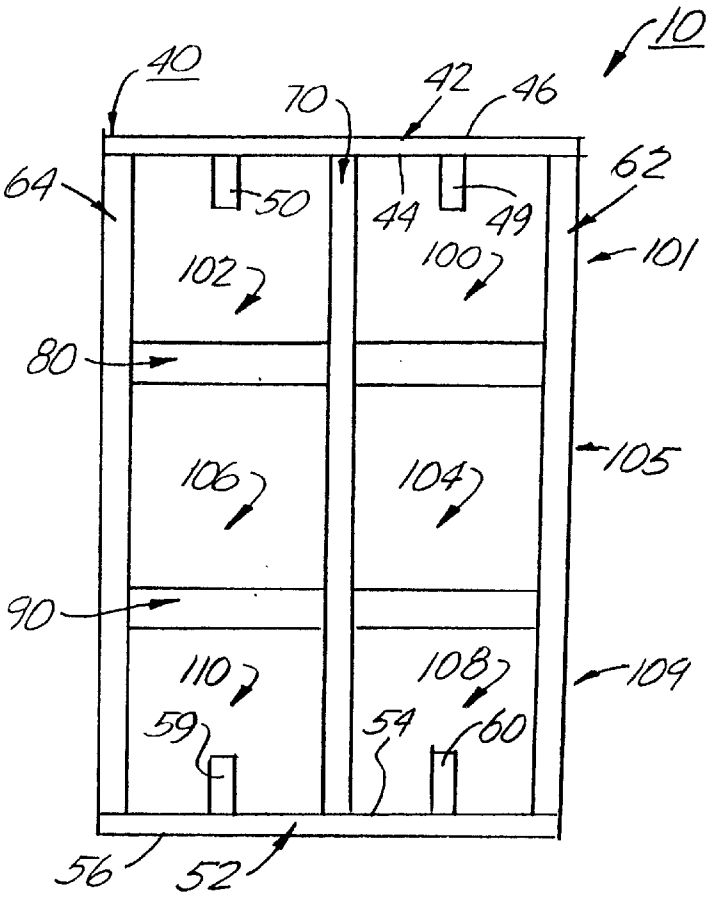
FIG. 3 is a bottom plan view of the multi-stone setting member of the present invention shown in FIG. 1.
Figure 2:
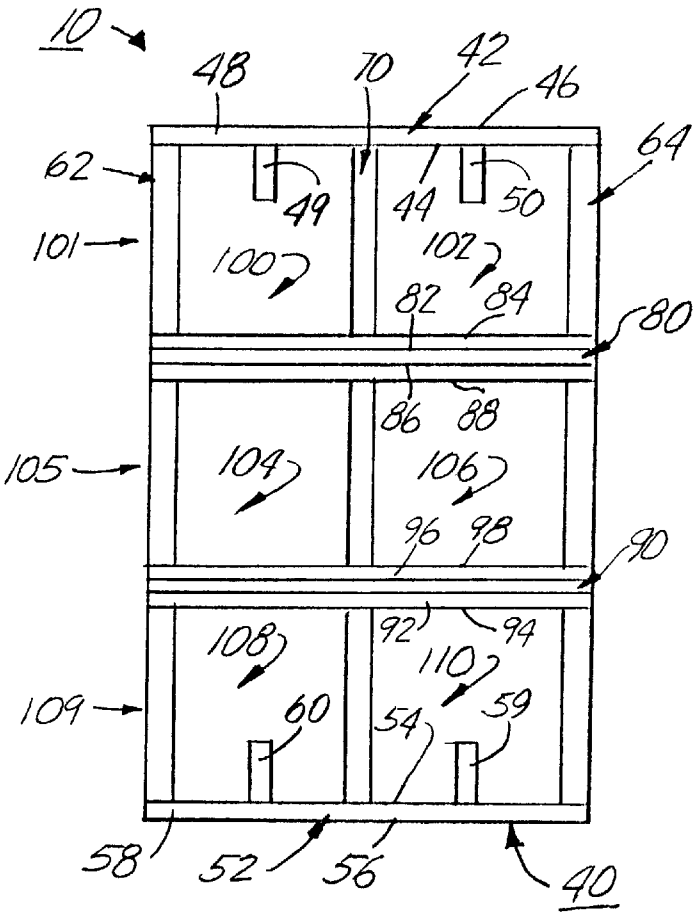
FIG. 2 is a top plan view of the multi-stone setting member of the present invention shown in FIG. 1.
Figure 5:
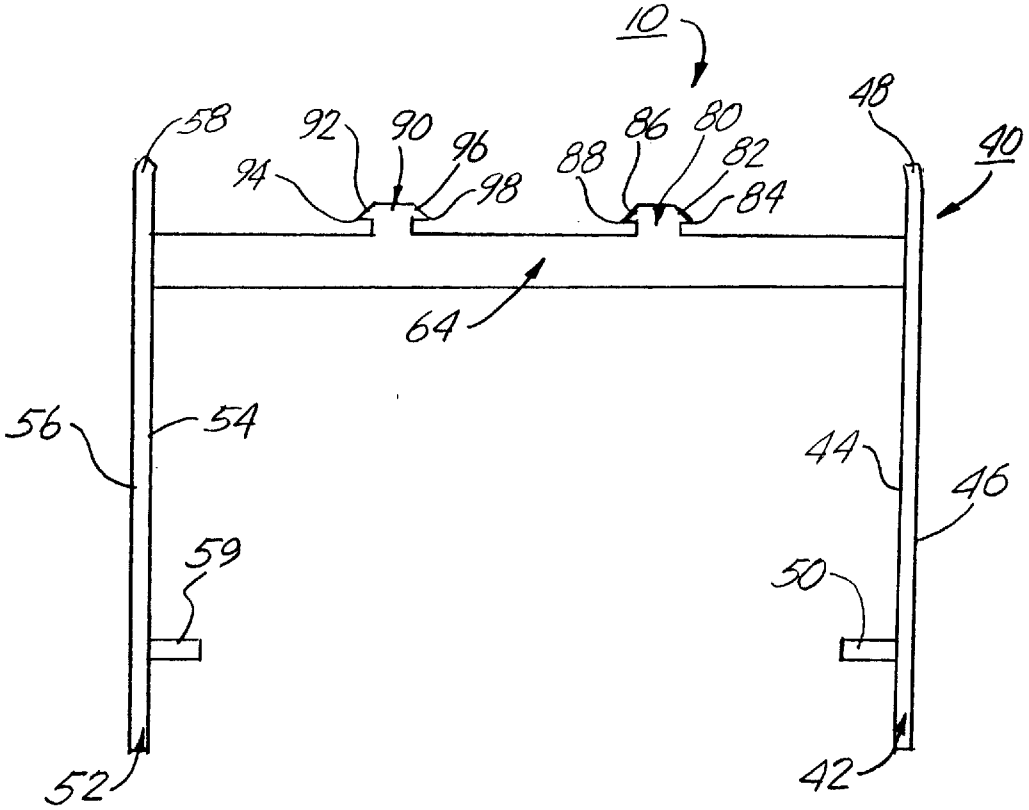
FIG. 5 is a side elevational view of the multi-stone setting member of the present invention shown in FIG. 1.
Figure 4:
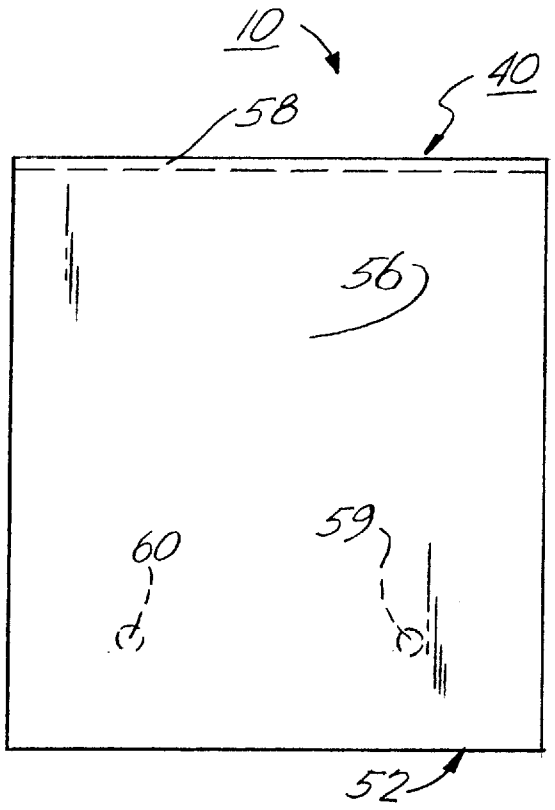
FIG. 4 is a side elevational view of the multi-stone setting member of the present invention shown in FIG. 1.
Figure 6:
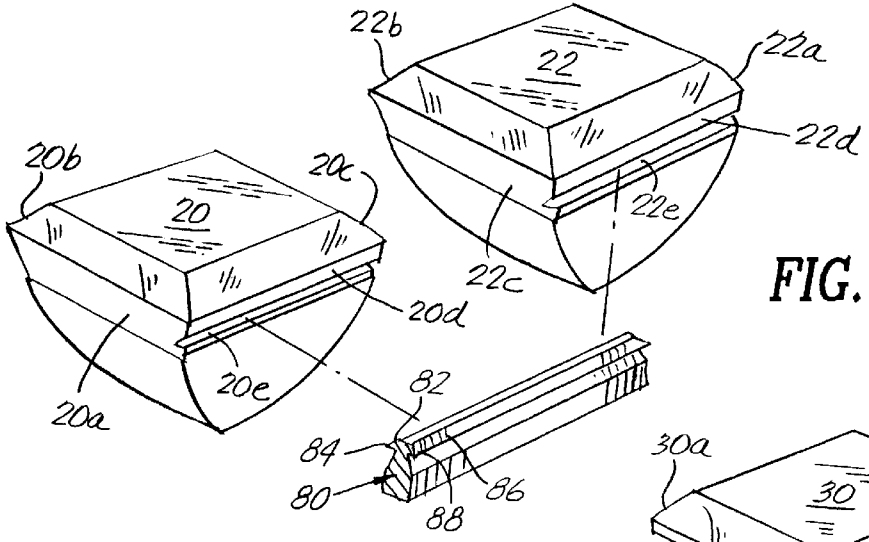
FIG. 6 is a top perspective view of the multi-stone round setting member of the present invention showing two square-shaped diamonds being slidably connected with the second upper crossbar of the frame member.
Figure 7:
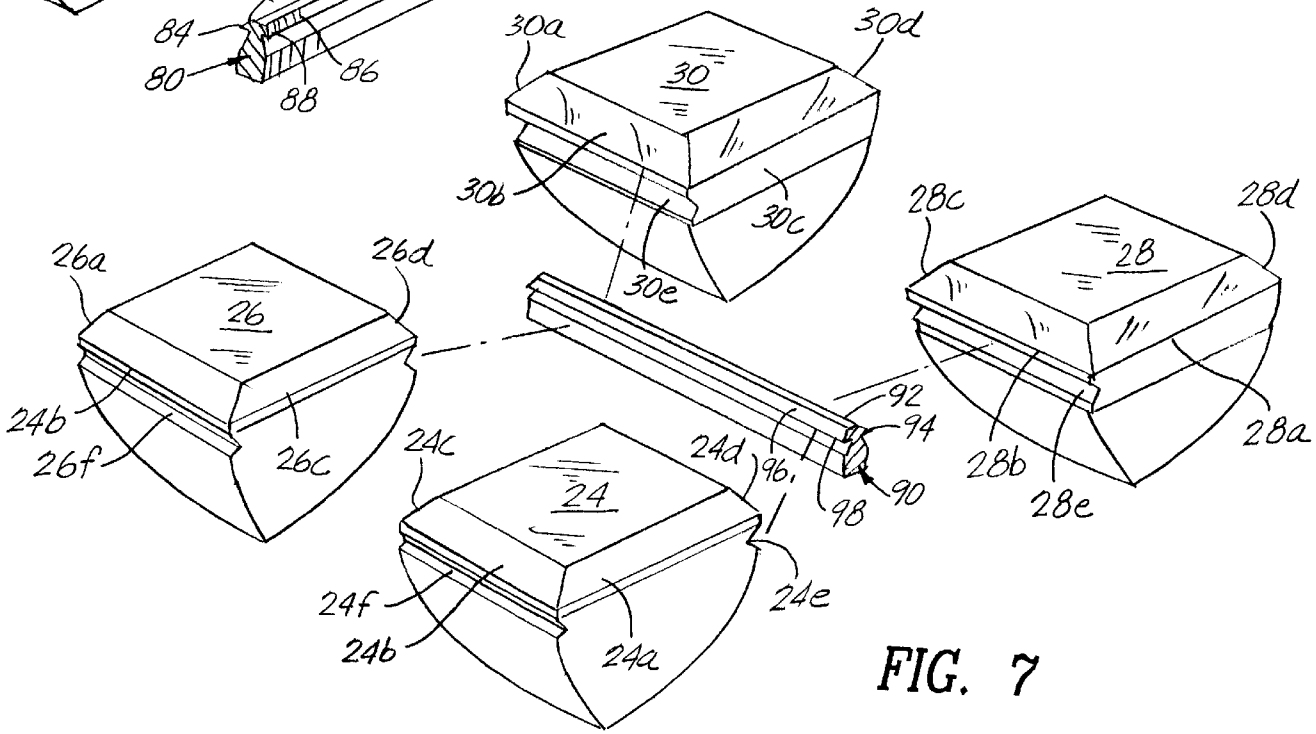
FIG. 7 is a top perspective view of the multi-stone setting member of the present invention showing four square-shaped diamonds being slidably connected with the third upper crossbar of the frame member.

Frame assembly 40 further includes a first crossbar 70 connected to the two opposing front and rear walls 42 and 52; and second and third or upper crossbars 80 and 90 being equally spaced-apart and parallel with each other, and are mounted on top of the first or lower crossbar 70. The second and third crossbars 80 and 90 are connected to the other two opposing side walls 62 and 64, respectively, as shown in FIGS. 1, 2 and 3 of the drawings. The first, second and third crossbars 70, 80 and 90 form a grid and are used for forming six (6) seats or seating areas 100, 102, 104, 106, 108 and 110 having a rectangular or square shape, as shown in FIGS. 1 and 2 of the drawings. Each of the six (6) seats 100 to 110 are used to retain and hold in place diamonds 20 to 30, respectively. The first, second and third crossbars 70, 80 and 90 define two outer rows 101 and 109 of seats (the first outer row 101 includes seats 100 and 102, and the second outer row 109 includes seats 108 and 110), and one inner row 105 of seats (the inner row 105 includes seats 104 and 106) for receiving the six diamonds 20 to 30 therein. Additionally, the first crossbar 70 extends in a first direction, the second crossbar 80 extends in a second direction perpendicular to the first direction, and the third crossbar 90 is parallel to the second crossbar 80 and also extends in the second direction, as shown in FIGS. 1 to 3 of the drawings. The second crossbar 80 includes a first wall surface 82 having a first retaining insert edge member 84 thereon, and also includes a second wall surface 86 having a second retaining insert edge member 88 thereon. The third crossbar 90 includes a first wall surface 92 having a first retaining insert edge member 94 thereon, and also includes a second wall surface 96 having a second retaining insert edge member 98 thereon.

The first outer row 101 includes diamonds 20 and 22 having grooved slots 20*e* and 22*e* formed on their respective side walls 20*d* and 22*d,* respectively, wherein grooved slots 20*e* and 22*e* of diamonds 20 and 22 engage the first retaining insert edge member 84 of the second crossbar 80 for nesting and seating the first outer row 101 of diamonds 20 and 22 on the second crossbar 80, as shown in FIG. 1 of the drawings. The second outer row 109 includes diamonds 28 and 30 having grooved slots 28*e* and 30*e* formed on their respective side walls 28*b* and 30*b,* respectively, wherein grooved slots 28*e* and 30*e* of diamonds 28 and 30 engage the first retaining insert edge member 94 of the third crossbar 90 for nesting and seating the second outer row 109 of diamonds 28 and 30 on the third crossbar 90, as shown in FIG. 1 of the drawings. The inner row 105 includes diamonds 24 and 26 having grooved slots 24*f* and 24*e,* and 26*f* and 26*e* formed on their opposite side walls 24*b* and 24*d,* and 26*b* and 26*d,* respectively, wherein grooved slots 24*f* and 26*f* of diamonds 24 and 26 engage the second retaining insert edge member 88 of the second crossbar 80 for nesting and seating of side walls 24*b* and 26*b* of diamonds 24 and 26 on the second crossbar 80. Also, grooved slots 24*e* and 26*e* of diamonds 24 and 26 engage the second retaining insert edge member 98 of the third crossbar 90 for nesting and seating of side walls 24*d* and 26d of diamonds 24 and 26 on the third crossbar 90, as depicted in FIG. 1 of the drawings.

The gemstone setting member 10 can be made of gold, silver, platinum, palladium, or other precious metals. Gemstone setting member 10 can also be made into different size setting members depending upon the size (carat weight) of the rectangular-shaped or square-shaped diamonds 20 to 30 being mounted therein. The total carat weight for the six gemstones or diamonds 20 to 30 typically is in the range of 0.18 to 2.00 carats per gemstone setting 10. Additionally, other types of gemstones such as rubies, emeralds and sapphires can be used for the multi-stone setting 10 of the present invention. Also, setting member 10 can be used with various types of jewelry holding members to form a ring, a pin, a brooch, a pendant, a clasp, a necklace, a bracelet, an anklet or earrings.

Operation of the Present Invention

The operation of the multi-stone setting member 10 of the preferred embodiment of the present invention, as shown in FIGS. 1, 9, 10 and 11 of the patent drawings, starts with the jeweler initially mounting one of the walls 42 or 52 to a jewelry vise (not shown) for the convenient assembly of each of the diamonds 20 to 30 within the seats 100 to 110, respectively, of gemstone setting member 10 by the jeweler. The jeweler's initial steps are to slidably mount the inner row 105 of diamonds 24 and 26 within seats 104 and 106, respectively, wherein the grooved slots 24*f* and 26*f* in diamonds 24 and 26 nestably engage the second retaining insert edge member 88 of the second crossbar 80 for nesting and seating of sidewalls 24*b* and 26*b* of diamonds 24 and 26 on the second crossbar 80, respectively, as depicted in FIGS. 1, 8, 9 and 10 of the drawings. Concurrently, the grooved slots 24*e* and 26*e* in diamonds 24 and 26 also nestably engage the second retaining insert edge member 98 of the third crossbar 90 for nesting and seating of side walls 24*d* and 26*d* of diamonds 24 and 26 on the third crossbar 90, respectively, as depicted in FIG. 1 of the drawings.

Figure 8:
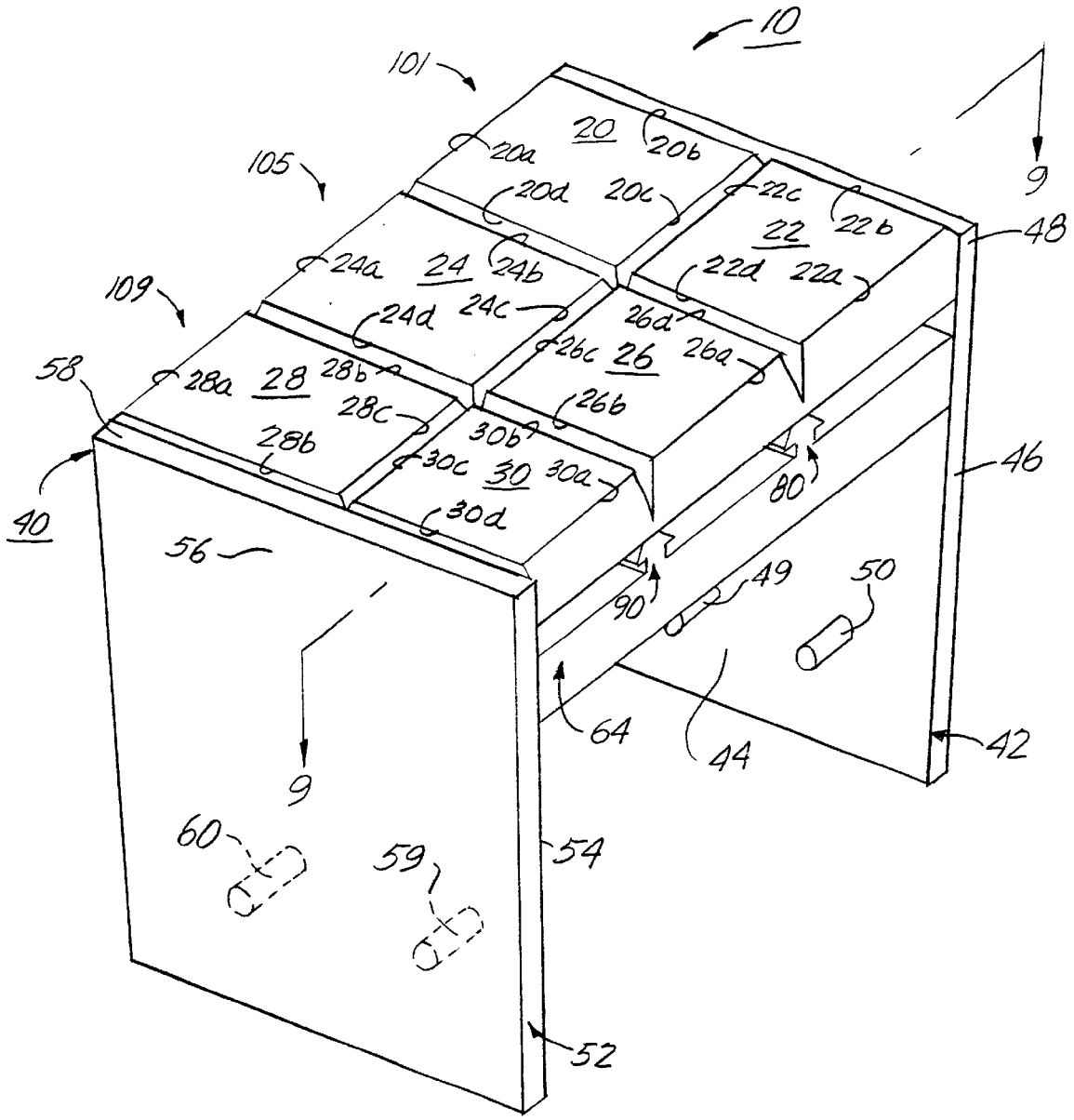
FIG. 8 is a top perspective view of the multi-stone setting member of the present invention showing six square-shaped diamonds seated within the six seats of the gemstone setting member.
Figure 9:
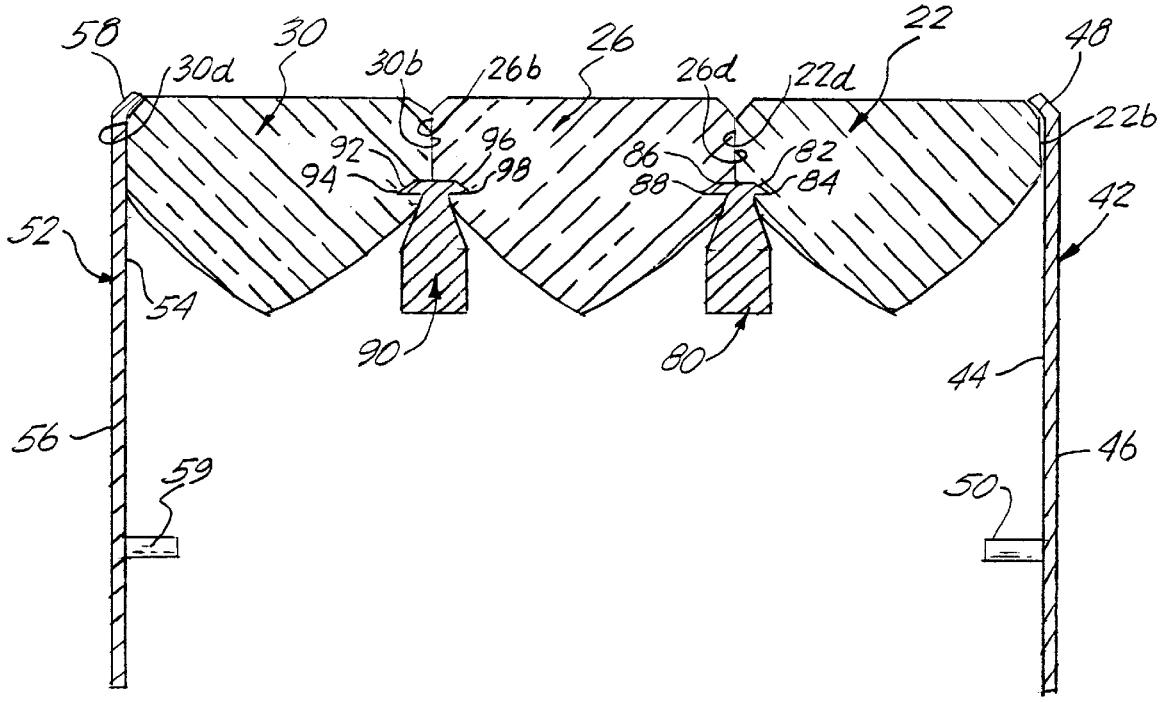
FIG. 9 is a cross-sectional view of the multi-stone setting of the present invention taken along lines 9—9 of FIG. 8 showing the second and third crossbars within the cut grooves of three diamonds.

The jeweler's next steps are to slidably set the grooved slots 20*e* and 22*e* in diamonds 20 and 22, respectively, onto the first retaining insert edge member 84 of the second crossbar 80, as depicted in FIGS. 1 and 8 of the patent drawings, for nesting and seating of the first outer row 101 of diamonds 20 and 22 on the second crossbar 80 within seats 100 and 102, respectively. Then the jeweler slightly bends the upper end 48 of front wall 42 inwardly to engage diamonds 20 and 22, respectively, such that the upper end 48 of retaining front wall 42 is adjacent to and in contact with the side walls 20*b* and 22*b* of diamonds 20 and 22, respectively, to hold them in place.

The jeweler again repeats the aforementioned steps for diamonds 28 and 30 by slidably setting the grooved slots 28*e* and 30*e* in diamonds 28 and 30, respectively, onto the first retaining insert edge member 94 of the third crossbar 90, as depicted in FIGS. 1 and 8 of the patent drawings, for nesting and seating of the second outer row 109 of diamonds 28 and 30 on the third crossbar 90 within seats 108 and 110, respectively. Then the jeweler slightly bends upper end 58 of rear wall 52 inwardly to engage diamonds 28 and 30, respectively, such that the upper end of rear retaining wall 58 is adjacent to and in contact with side walls 28*d* and 30*d* of diamonds 28 and 30, respectively, to hold them in place.

The jeweler's final step is to attach and connect the front and rear walls 42 and 52 of frame assembly 40 via the positioning pins 49 and 50, 59 and 60, respectively, to the receiving hole openings 14*a* and 14*b,* and 16*a* and 16*b* of the side walls 15 and 17 of ring member 12, as depicted in FIG. 10 of the drawings. This forms a newly configured diamond ring 12, as shown in FIGS. 11, 12 and 13 of the drawings, via the multi-stone setting member 10 of the present invention.

Advantages of the Present Invention

Accordingly, an advantage of the present invention is that it provides for a multi-stone setting member for holding therein six rectangular-shaped or square-shaped gemstones in which the combined aggregate of the six gemstones gives a larger appearance than that of a single gemstone of a similar carat weight (i.e., a 1.2 carat presentation of the combined six gemstones appears as large as a 2.0 carat gemstone, as the present invention would have a larger table).

Another advantage of the present invention is that it provides for a multi-stone setting member having six gemstones therein that is less expensive than a single gemstone of a similar carat weight (i.e., the 1.2 carat presentation of the combined six gemstones is less expensive than an actual 1.2 carat single gemstone of the same carat weight).

Another advantage of the present invention is that it provides for a multi-stone setting member having six princess cut gemstones therein which gives the appearance that the setting is substantially invisible at distances greater than 12 inches from the jewelry product.

Another advantage of the present invention is that it provides for a multi-stone setting member that can be varied in size depending upon the total combined carat weight of the six gemstones within the setting member.

Another advantage of the present invention is that it provides for a multi-stone setting member that can be made from precious metals such as gold, silver, platinum or palladium for setting precious gemstones including diamonds, rubies, sapphires, emeralds and the like.

Another advantage of the present invention is that it provides for a multi-stone setting member that can be attached to a jewelry ring by a plurality of positioning pins integrally connected to the member housing.

Another advantage of the present invention is that it provides for a multi-stone setting member having six gemstones therein for use in personal adornment in the form of ornamental jewelry such as rings.

Another advantage of the present invention is that it provides for a multi-stone setting member that can be produced in an economical manner and is readily affordable by the jewelry consumer.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A multi-stone setting member having six gemstones or diamonds for attachment to a ring, comprising:

a) a rectangular-shaped setting member having a first crossbar extending in a first direction; a second crossbar having a first insert device extending in a second direction perpendicular to said first direction; a third crossbar having a second insert device and being parallel to said second crossbar and also extending in said second direction; said first crossbar being located in a different plane than said second and third crossbars;

b) said first, second and third crossbars forming six seats each for receiving one of six gemstones or diamonds; said first, second and third crossbars defining two outer rows of seats to form four outer seats, and one inner row of seats to form two inner seats for receiving said six gemstones; to form a first outer row of gemstones, a second outer row of gemstones, and an inner row of gemstones, and said first and second outer rows of gemstones forming four outer gemstones;

c) said first outer row of gemstones having a first set of inner side walls for engaging said second crossbar, said first set of inner side walls having grooves formed therein for seating said first outer row of gemstones on said first insert device of said second crossbar;

d) said second outer row of gemstones having a second set of inner side walls for engaging said third crossbar, said second set of inner side walls having grooves formed therein for seating said second outer row of gemstones on said second insert device of said third crossbar;

e) said inner row of gemstones having first inner side walls for engaging said second crossbar and second inner side walls for engaging said third crossbar; said first and second inner side walls having grooves formed therein for seating said inner row of gemstones on said first insert device and said second insert device of said second and third crossbars, respectively;

f) said setting member having a frame assembly; said frame assembly including a front wall, a rear wall and side walls;

g) said front and rear walls of said frame assembly each having an upper end for engaging said four outer gemstones in said first and second outer rows of gemstones to keep said four outer gemstones seated within said four outer seats of said setting member; and h) said front and rear walls each having a pair of positioning pins for connecting and attaching the setting member to the sides of a ring.

2. A multi-stone setting member in accordance with claim 1, wherein said rectangular-shaped setting member includes said frame assembly having four sides and four wall members, said first crossbar being connected to two opposing wall members, said second and third crossbars being mounted on top of said first crossbar and being connected to the other two opposing wall members for forming said six seats, said six seats each having a rectangular shape.

3. A multi-stone setting member in accordance with claim 2, wherein said six seats each have a square shape.

4. A multi-stone setting member in accordance with claim 2, wherein two of said four wall members each have upper ends, and wherein the upper ends of said two wall members are higher than said other two wall members for directly engaging the side walls of said four outer gemstones.

5. A multi-stone setting member in accordance with claim 1, wherein said front and rear walls have interior wall surfaces, and each of said pairs of positioning pins are centrally located on said interior wall surfaces of said front and rear walls.

6. A multi-stone setting member in accordance with claim 1, wherein said multi-stone setting member is made of precious metals selected from the group consisting of gold, silver, platinum, and palladium.

7. A multi-stone setting member in accordance with claim 1, wherein the size of said multi-stone setting member corresponds to the weight of said six gemstones, wherein the weight is in the range of 0.18 to 2.00 carats.

8. A multi-stone setting member in accordance with claim 1, wherein said insert devices include first and second projection members extending outwardly from said second and third crossbars.

* * * * *